US010567904B2

(12) United States Patent
Sahay

(10) Patent No.: US 10,567,904 B2
(45) Date of Patent: Feb. 18, 2020

(54) SYSTEM AND METHOD FOR HEADPHONES FOR MONITORING AN ENVIRONMENT OUTSIDE OF A USER'S FIELD OF VIEW

(71) Applicant: Harman International Industries, Incorporated, Stamford, CT (US)

(72) Inventor: Pratyush Sahay, Karnataka (IN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/684,317

(22) Filed: Aug. 23, 2017

(65) Prior Publication Data

US 2019/0069117 A1 Feb. 28, 2019

(51) Int. Cl.

| | |
|---|---|
| ***H04S 7/00*** | (2006.01) |
| ***G08B 13/16*** | (2006.01) |
| ***H04R 1/10*** | (2006.01) |
| ***G08B 3/10*** | (2006.01) |
| ***H04R 5/033*** | (2006.01) |

(52) U.S. Cl.

CPC ..... *H04S 7/304* (2013.01); *G08B 3/10* (2013.01); *G08B 13/1618* (2013.01); *H04R 1/1041* (2013.01); *H04R 5/033* (2013.01); *H04R 2420/07* (2013.01); *H04R 2460/01* (2013.01); *H04R 2460/07* (2013.01)

(58) Field of Classification Search

CPC ..... H04S 7/304; G08B 3/10; G08B 13/1618; H04R 5/033; H04R 1/1041; H04R 2420/07; H04R 2460/01; H04R 2460/07

USPC ..... 381/309, 300, 74, 375, 374, 370, 122, 381/111; 367/87, 7, 92, 117; 340/943; 702/39, 159

See application file for complete search history.

(56) References Cited

U.S. PATENT DOCUMENTS

| | | | | |
|---|---|---|---|---|
| 7,330,398 | B2 | 2/2008 | Yang | |
| 7,714,704 | B1 * | 5/2010 | Mellen | B60R 1/00 340/425.5 |
| 2005/0248233 | A1 * | 11/2005 | Pompei | G10K 15/02 310/322 |
| 2008/0252595 | A1 * | 10/2008 | Boillot | G06F 3/011 345/156 |
| 2009/0109084 | A1 * | 4/2009 | Kiang | G01S 13/003 342/109 |

(Continued)

FOREIGN PATENT DOCUMENTS

| | | | |
|---|---|---|---|
| EP | 0661906 | A1 | 7/1995 |
| JP | 2011077991 | A | 4/2011 |

*Primary Examiner* — Vivian C Chin
*Assistant Examiner* — Con P Tran
(74) *Attorney, Agent, or Firm* — Brooks Kushman P.C.

(57) ABSTRACT

In at least one embodiment, a computer-program product embodied in a non-transitory computer readable medium that is programmed to provide an alert for a user of an environment outside of the user's visual field of view is provided. The computer-program product includes instructions to receive an echo profile indicative of at least one object outside of the user's visual field of view from headphones and to receive a command indicative of at least one object to detect on the echo profile from the user. The computer-program product includes instructions to generate an alert for the user to notify the user of a detected object in the user's visual field of view in the event the echo profile includes the at least one object.

17 Claims, 5 Drawing Sheets

(56) References Cited

U.S. PATENT DOCUMENTS

| | | | | |
|---|---|---|---|---|
| 2012/0215519 | A1* | 8/2012 | Park | G06F 17/289 704/2 |
| 2012/0280824 | A1* | 11/2012 | Zelepugas | H04R 1/1041 340/670 |
| 2013/0101175 | A1* | 4/2013 | Lynch | G01C 3/00 382/106 |
| 2013/0259255 | A1 | 10/2013 | Schul et al. | |
| 2017/0354196 | A1* | 12/2017 | Tammam | B60Q 9/008 |

* cited by examiner

SYSTEM AND METHOD FOR HEADPHONES FOR MONITORING AN ENVIRONMENT OUTSIDE OF A USER'S FIELD OF VIEW

TECHNICAL FIELD

Aspects disclosed herein generally relate to a system and method for headphones for monitoring an environment outside of a user's field of view.

BACKGROUND

Given a fixed head pose, a human may be visually-restricted by the field of view provided by their eyes, which horizontally is around 114 degrees binocularly and 60-70 degrees monocularly. Any visually interesting event that occurs within the field of view may thus be seen by the human.

However, there may be certain situations where a user (i.e., a user that is listening to media from their headphones) may be interested in visual activities that occur outside their respective field of view. For example, a user walking on the side road may want to know if a moving vehicle behind the user could be on course to hit the user in the next few moments. Alternatively, a user may be walking through a crime-prone area and the user may want to be alerted when some other person is in close proximity to the user, particularly when the other person is outside of the field of view for the user. Providing the user with an alert about such and other various "visually interesting" events that occur on the user's "blind field of view" is currently not possible.

SUMMARY

In at least one embodiment, a computer-program product embodied in a non-transitory computer readable medium that is programmed to provide an alert for a user of an environment outside of the user's visual field of view is provided. The computer-program product includes instructions to receive an echo profile indicative of at least one object outside of the user's visual field of view from headphones and to receive a command indicative of at least one object to detect on the echo profile from the user. The computer-program product includes instructions to generate an alert for the user to notify the user of a detected object in the user's visual field of view in the event the echo profile includes the at least one object.

In at least one embodiment, a listening apparatus for monitoring an environment outside of a user's visual field of view is provided. The apparatus comprises headphones including at least one audio speaker and at least one microphone. The headphones being programmed to receive an audio stream from a mobile device and to playback the audio stream via the at least one audio speaker. The headphones being further programmed to transmit a first signal in an ultrasonic range to an area exterior to the headphones and to receive, via the at least one microphone, a reflected first signal in the ultrasonic range from at least one object surrounding the user. The headphones being further programmed to generate an echo profile indicative of at least one object outside of the user's visual field of view in response to the received reflected first signal and to transmit the echo profile to the mobile device to alert the user of the least one object outside of the user's visual field of view.

In at least one embodiment, an apparatus for providing an alert for a user of an environment outside of the user's visual field of view is provided. The apparatus includes a mobile device being programmed to receive an echo profile indicative of at least one object outside of the user's visual field of view from headphones and to receive a command indicative of at least one object to detect on the echo profile from the user. The mobile device is further configured to generate an alert for the user to notify the user of a detected object in the user's visual field of view in the event the echo profile includes the at least one object.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The embodiments of the present disclosure generally provide for a plurality of circuits or other electrical devices. All references to the circuits and other electrical devices and the functionality provided by each are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microcontrollers, a graphics processor unit (GPU), integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices may be configured to execute a computer-program that is embodied in a non-transitory computer readable medium programmed to perform any number of the functions as disclosed.

Aspects disclosed herein generally provide a headphone-mobile device pair that is environmentally-aware and that focuses on the blind field of view of the user. An alert is provided to the user about visually interesting events that may be occurring in the user's blind field of view at an instance in time. For example, the disclosed system includes one or more ultrasonic emitters positioned on an outside portion of ear-cups of the headphones. The computing capability provided by the mobile device and sensory feedback from the headphone determine whether an object of interest is positioned in a blind field of view of the user and alerts the user of the same. The system also allows for a dynamic addition of rules for detecting various objects of interest for the user. These aspects and others will be discussed in more detail below.

Figure 1:
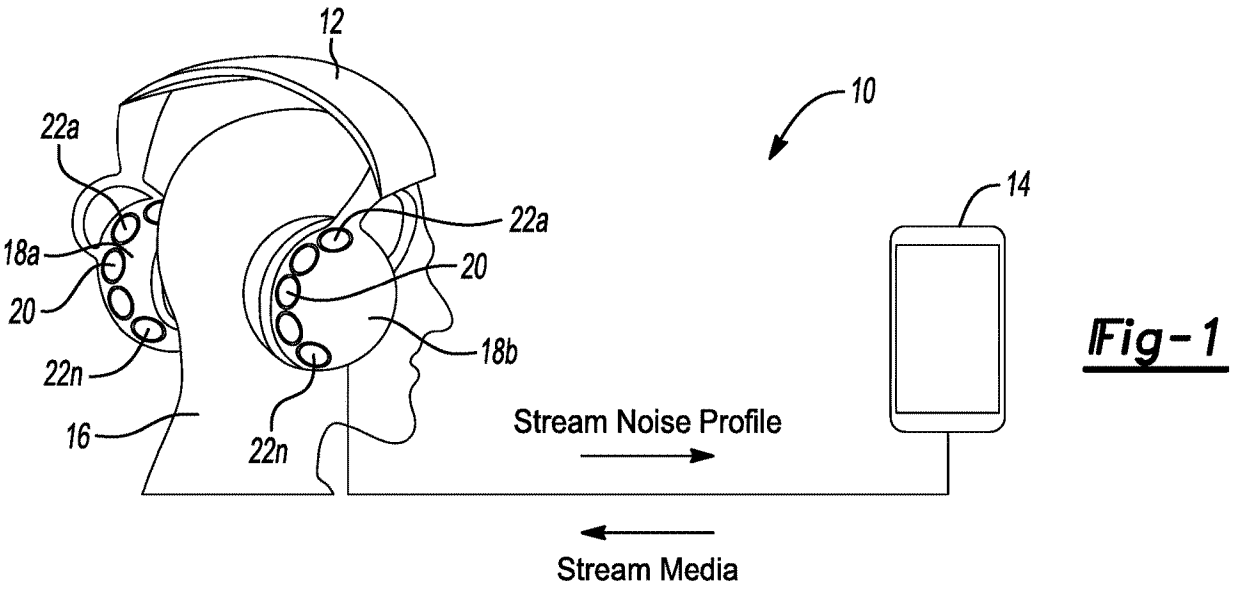
FIG. 1 generally depicts a system for monitoring an environment outside of a user's field of view in accordance to one embodiment.

FIG. 1 generally depicts a system 10 for headphones in an environment outside of a user's field of view in accordance to one embodiment. The system 10 includes headphones 12 and a mobile device 14. The headphones 12 may be implemented as active noise cancelling microphones. In general, the mobile device 14 may transmit audio data (or stream audio data) to the headphones 12 for playback for a user 16. The mobile device 14 may be implemented as a cellular telephone, laptop, computer, tablet computer, etc. The headphones 12 and the mobile device 14 may bi-directionally communicate with one another. The headphones 12 and the mobile device 14 may be hardwired coupled with one another. Alternatively, the headphones 12 and the mobile device 14 may be wirelessly coupled to one another and engage in data transfer via Bluetooth®, WiFi, or other suitable wireless interface.

The headphones 12 generally include a left ear cup 18*a* and a right ear cup 18*b*. Each ear cup 18*a* and 18*b* generally includes a microphone 20 and a plurality of transmitters 22*a*-22*n* ("22"). The microphone 20 may be tuned to capture audio in a human aural region (e.g., 20 Hz-20 kHz) for active noise cancellation purposes. The microphone 20 may also be tuned to capture audio in an ultrasonic range (e.g., greater than 20 kHz) which falls outside of the human aural region. The transmitters 22 may be ultrasonic transmitters that transmit signals in excess of 20 kHz. Each transmitter 22 may be embedded on an outside portion of the ear cup 18*a* and 18*b*. Each transmitter 22 may also be orientated on the ear cup 18*a*, 18*b* to face a blind view of the user 16 when the user 16 has the headphones 12 on. The transmitters 22 are positioned on the ear cups 18*a* and 18*b* to adequately cover a complete blind view for the user 16 when the user 16 has the headphones 12 positioned thereon.

The transmitters 22 are each configured to transmit modulated ultrasonic signals exterior to the headphones 12 (i.e., into the environment surrounding the user 16). The microphone 20 is configured to receive reflected (or echo) modulated ultrasonic signals from objects surrounding the user 16. Because the transmitters 22 transmit the ultrasonic signals as modulated signals, these signals are discernable by the headphones 12 in comparison to stray ultrasonic signals that are received from stray sources. The headphones 12 generate an echo-profile based on at least one reflected modulated signal that is received by the microphone 20. The echo profile is generally indicative of any number of objects that may be located in an environment that is outside of a user's visual field of view. The headphones 12 transmit the same as a streaming noise profile to the mobile device 14 (or to a processing block (not shown)). For example, once the headphones 12 detect a sound signature of the modulated ultrasonic signals, the headphones 12 command the mobile device 14 (or processing block) to process the data on the echo-profile (i.e., the data on the streaming noise profile). The received sound signature is in the form of a depth/range map (i.e., that may be generated SONARs or LIDARS). The sound signature is generally indicative of the distance an object is from the transmitters 22. If visualized in the form of a monochrome image (e.g., see FIGS. 3A and 3B), objects farther from the transmitter 22 may exhibit a darker gray color. Depending upon the resolution of the transmitter 22, regions on the same object at different distances from the transmitter 22 may or may not be represented by different shades. The mobile device 14 (or a server) processes the data on consecutive echo-profiles to determine if there is a visual event of interest that is occurring in the blind field of view for the user 16. It is recognized that the headphones 12 and the mobile device 14 may request services from one another. For example, once the headphones 12 detect the echo profile based on the reflected modulated signals as received at the microphone 20, the headphones 12 may wirelessly transmit a command to the mobile device 14 to initiate processing the streaming noise profile. These aspects and others will be discussed in more detail below.

Figure 2:
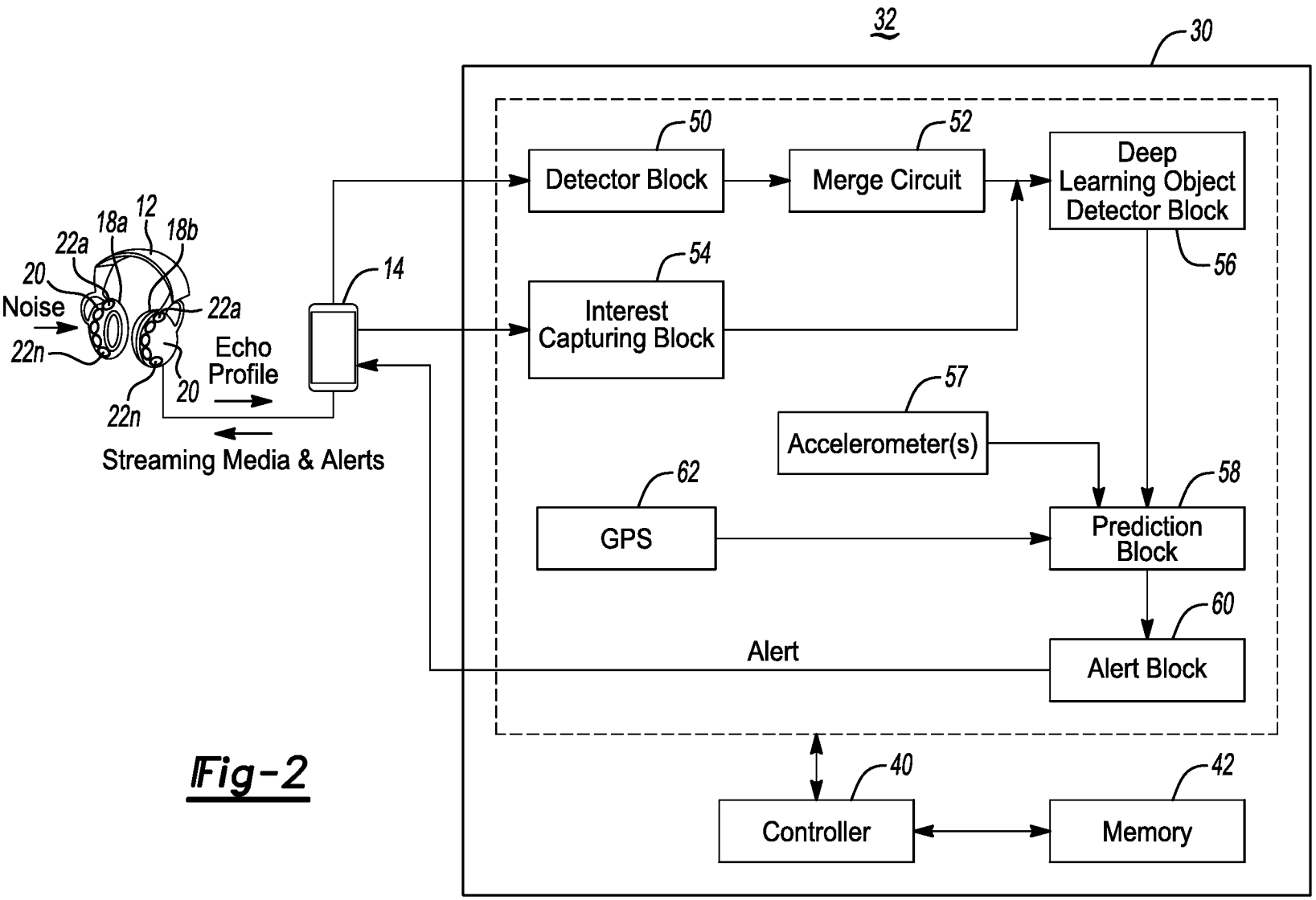
FIG. 2 generally depicts a more detailed implementation of a mobile device in accordance to one embodiment.

FIG. 2 generally depicts a more detailed implementation of the system 10 in accordance to one embodiment. The system 10 generally includes the headphones 12, the mobile device 14, and a processing block 30. The processing block 30 may be positioned on the mobile device 14. Alternatively, the processing block 30 may be located on a server 32 that is remote from the mobile device 14. In general, the processing block 30 is configured to receive data in the form of a streaming noise profile from the headphones 12 and to process the data to determine if there is a visual event of interest that is occurring in the blind view for the user 16. In the event the processing block 30 determines that there is a visual event of interest for the user 16, the processing block 30 wirelessly transmits an alert to the headphones 12 via the mobile device 14. Assuming for purposes of explanation that the processing block 30 is located on the server 32, the mobile device 14 may transmit the echo profile and any other local information thereon as needed to locate objects in the blind field of view of the user 16 to the server 32. In this case, the processing block 30 may then wirelessly transmit an alert signal to the mobile device 14. The mobile device 14 may then issue a text message to the user 16. Alternatively, the mobile device 14 may transmit an alert signal to the headphones 12 to audibly alert the user of the visual event of interest.

The processing block 30 generally includes a controller 40 and memory 42 to execute operations (or instructions) to perform any noted operations by the processing block 30. The processing block 30 also includes a detector block 50, a merge circuit 52, an interest capturing block 54, a deep learning-based object detection (DLBOD) block 56, an accelerometer 57, a prediction block 58, an alert block 60, and a global positioning system (GPS) chipset 62. The GPS chipset 62 and the accelerometer 57 may be implemented on the processing block 30 if the processing block 30 is on the mobile device 14. If the processing block 30 is implemented on the server 32, the mobile device 14 provides the GPS information (or location information) and accelerometer information to the server 32. It is recognized that the user 16 may establish various rules regarding the environmental-context which correspond to the user's 16 desired interest when detected in the user's blind field of view. One rule may be, for example, monitoring for vehicles in the user's 16 blind field of view when the user is walking near busy roads. The interest capturing block 54 receives the rules regarding the environmental-context which corresponds to the desired interest. This aspect will be discussed in more detail below.

The detector block 50 may receive the echo profile (or the streaming noise profile) from the headphones 12. In general, the interest capturing block 54 may comprise instructions that are executed by the controller 40 for deriving an intent or action from the echo profile based on the rule as established by the user 16. For example, the interest capturing block 54 may encompass a natural language processing (NLP)-based service which provides the intent and an action extraction based on the rule as established by the user 16. As noted above, the user 16 may establish a rule for monitoring vehicles in the user's 16 blind field of view. The user may input the rules via a user interface on the mobile device 14. For example, the interest capturing block 54 may convert a rule as established by the user 16 such as "Monitor vehicles in my blind field of view when I am walking on the side road" into an "interest" as follows:

action—"monitor for crash", performed using echo from ultrasonic transmitter 22 object—"vehicles", detected using deep learning from the echo profile region—"blind field of view", i.e., back side of the user 16 environment—"side road", decided by mobile device 14 based on GPS data (i.e., from GPS chipset 62)

activity—"walking", decided by activity detection using accelerometers on mobile device 14.

The mobile device 14 may also provide the user 16 with the option of dynamically updating the types of objects that the user 16 may be interested in based on different environmental contexts. For example, the user 16 may add a rule that monitors vehicles in their respective blind field of view when the user 16 is walking on a particular road (i.e., as selected by the user 16) or that monitors individuals within a particular distance from the user (i.e., as selected by the user 16) including the particular time (i.e., as selected by the user 16). In another example, the user 16 may specify with the mobile device 14 to monitor for individuals within 1 meter of the user 16 that is in the user's blind field of view when the user 16 is positioned a XYZ garden after 8 pm.

The detector block 50 is generally configured to determine whether the echo profile as received from the headphones 12 has a frequency that is within the ultrasonic range (e.g., above 20 kHz). Thus, this condition is indicative of the headphones 12 detecting an echo from the transmitted ultrasonic signals of the transmitters 22. If the detector block 50 determines that the echo profile as received on the streaming noise profile is within the ultrasonic range, then the merge circuit 52 merges or combines the data from the two echo profiles (i.e., data from the from the right and the left channels of the echo profile) as received from the headphones 12 (i.e., right or left cups of the headphones 12). This ensures that objects in the blind field of view are seen in their entirety and the DLBOD block 56 may infer object types based on the entire object size.

Figure 3B:
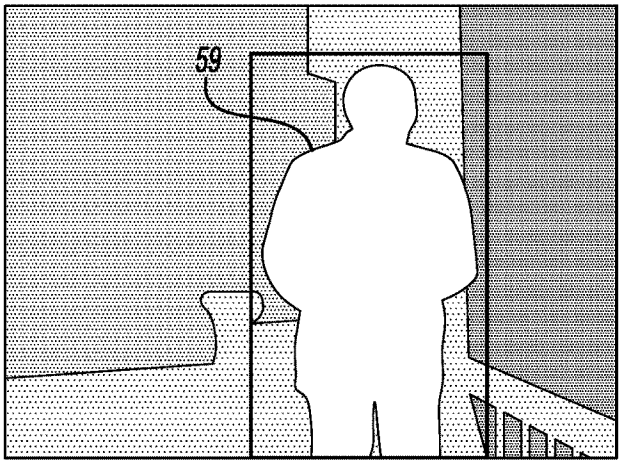
FIGS. 3A-3B generally depict depth maps with various objects in accordance to one embodiment.
Figure 3A:
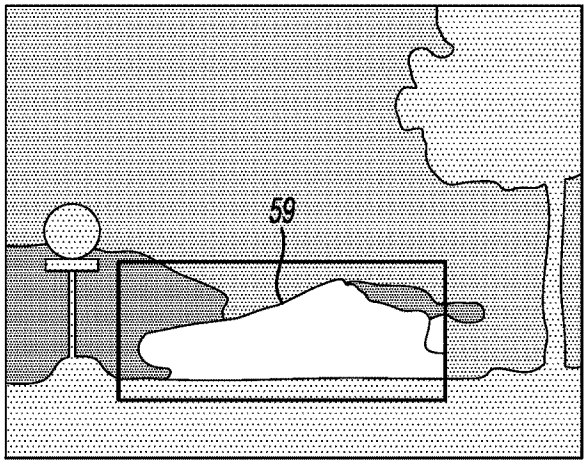

For example, the merge circuit 52 combines the two streaming echo profiles (e.g., left and right data) to form a single stitched echo profile. The single stitched echo profile may be in the form of an image depth map. The merge circuit 52 combines the data from the two channels of the echo profile to form a single homogenous scene. FIGS. 3A and 3B each depict a single stitched echo profile (or image depth map). The DLBOD block 56 processes this depth map and determines the objects of interest 59 in this input and places a bounding box around the objects 59. For example, FIG. 3A depicts a vehicle that is highlighted as an object of interest 59 and FIG. 3B depicts a human that is also highlighted as an object of interest. In general, each single stitched echo profile includes a cumulative stitching of all echo signals as received from the headphones 12.

The DLBOD block 56 performs a deep learning based object detection for object(s) in the single stitched echo profile. For example, the deep learning based object detection block 56 is configured to detect the objects as specified in the rule(s) by the user 16. The DLBOD block 56 detects the specified object 59 in the image map generated by the merge circuit 52. The DLBOD block 56 is configured to attach an ID to each object that is detected based on the rule. The DLBOD block 56 may be a deep neural network that includes several layers of convolutional filters. Taking in the depth map corresponding to the merged echo profile as the input, the DLBOD block 56 passes the depth map through various layers of the deep neural network.

The deepest layer filters of the DLBOD block 56 learn to extract abstract concepts such as circular shapes, boxes, etc. while the earlier layers learn to extract simple features such as edges, corners, etc. During the training stage, the DLBOD block 56 learns the representation of objects by hierarchically combining the extracted features from the earlier layers to the deepest layers. During inference time execution, the DLBOD block 56 compresses the extracted features of the input and compares the same against a memory of features (or previously known objects) that were previously learned by the deep neural network of the DLBOD block 56. The DLBOD block 56 then determines the object class after comparing the extracted features against the previously learned features in the memory. When the DLBOD block 56 detects an object at a time instant "t", the DLBOD block 56 attaches an identification (or 'ID i(t)') to the object. This ensures that when the same object is detected at another time instant (or 't+n'), the DLBOD block 56 may treat an ID (e.g., ID i(t)) as the same object instead of treating the detected object as a separate object. Thus, for a sequence of frames running from 't' to 't+n", if a single object exists in the depth map, the DLBOD block 56 detects the object as a single object instead of detecting it as 'n' different objects.

The GPS chipset 62 provides information corresponding to the location of the mobile device 14 (i.e., the user 16) to the prediction block 58. The accelerometer 57 may provide acceleration information in three axes which correspond to movement of the mobile device 14. The prediction block 58 utilizes, for example, a Kalman-filter to predict a future location of the object identified and tagged by the DLBOD block 56. For example, the prediction block 58 performs a future motion estimation on position information for all objects in the vicinity of the user 16 in at least one prior sample (or a previous sample) of the stream that includes the single stitched echo profile. In addition, the prediction block 58 predicts a future position of the user 16 based on the location information provided by the GPS chipset 62 and/or acceleration information from the accelerometer 57. For future motion estimation, the prediction block 58 executes a Kalman-filter based algorithm which receives inputs (possible noisy) as a series of locations of the tagged objects from the DLBOD block 56 obtained from the previous frames and estimates the future position of these objects by Bayesian inference. The prediction block 58 builds a probability distribution over the observed variables at each timeframe and produces an estimate of the unknown variable which may be more accurate than what could be obtained from a single observation alone.

The prediction block 58 transmits a command to the alert block 60 in response to determining that the object being monitored is deemed to pose a threat to the user 16 based on the future position of the user 16 and on the future position of the object being monitored in the blind view of the user 16. The alert block 60 alerts the user 16 if the object being monitored is predicted to pose a threat to the user 16 in the near future in response to a command from the prediction block 58. For example, the alert block 60 may transmit the alert such that an alert is audibly played for the user 16 or visually/audibly provided on the mobile device 14. The mobile device 14 may transmit the alert to the headphones 12 to audibly alert the user 16. The user 16 may then change his/her position accordingly to avoid impact or an encounter with the object in response to the alert.

In addition, the mobile device 14 may be configured to stream images on a display (not shown) thereof of the object that is located in the user's 16 blind field of view. For example, the vehicles as noted above, that are identified as an object to monitor in the user's blind field of view, may be highlighted on the display to enable the user 16 to take action that avoids the possibility of a future collision or other undesirable event.

Figure 4:
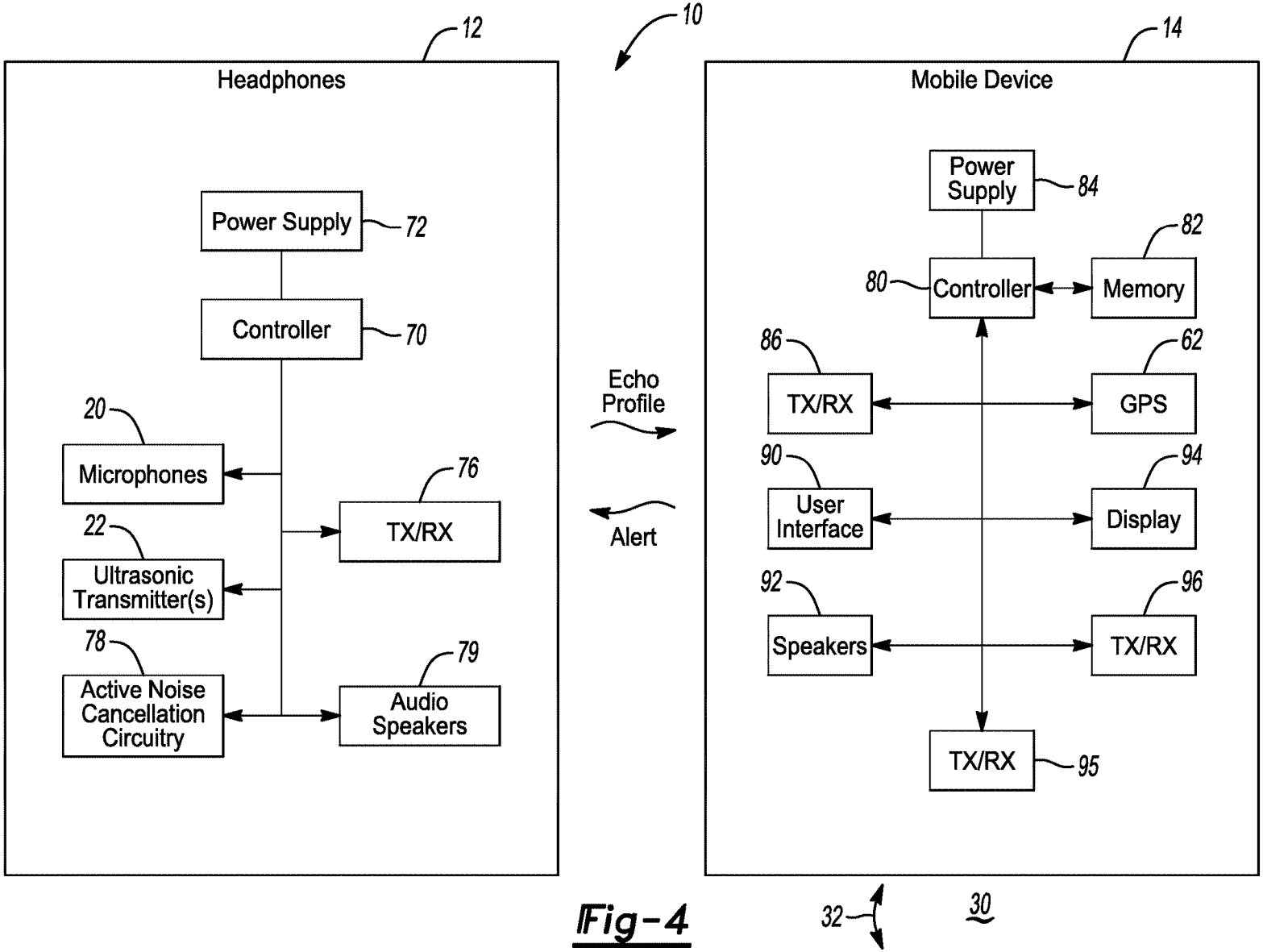
FIG. 4 generally depicts a more detailed implementation of the headphones and the mobile device in accordance to one embodiment.

FIG. 4 generally depicts a more detailed implementation of the headphones 12 and the mobile device 14 in accordance to one embodiment. The headphones 12 generally include the microphone 20, the transmitter 22, at least one controller 70 (or at least one microprocessor) (hereafter controller 70), a power/battery supply 72, a transceiver 76, active noise cancellation circuitry 78, and speaker(s) 79. The power supply 72 powers the headphones 12 (e.g., the electrical devices located within the headphones 12). The microphone 20 may be tuned to capture audio in a human aural region (e.g., 20 Hz-20 kHz) for media consumption and active noise cancellation purposes. The microphone 20 may also be tuned to capture audio in an ultrasonic range (e.g., greater than 20 kHz). The transmitters 22 may be ultrasonic transmitters that transmit signals in excess of 20 kHz. Each transmitter 22 may be embedded on an outside portion of the ear cup 18*a* and 18*b* (see FIG. 1). Each transmitter 22 may also be orientated on the ear cup 18*a*, 18*b* (see FIG. 2) to face a blind view of the user 16 when the user 16 has the headphones 12 on. The arrangement of the transmitters 22 on the ear cups 18*a* and 18*b* are positioned to adequately cover a complete blind field of view for the user 16 when the user 16 has the headphones 12 positioned thereon.

The transmitters 22 are each configured to transmit modulated ultrasonic signals exterior to the headphones 12 (i.e., into the environment surrounding the user 16). The microphone 20 is configured to receive reflected (or echo) modulated ultrasonic signals from objects surrounding the user 16. Because the transmitters 22 transmit the ultrasonic signals as modulated signals, these signals are discernable by the controller 70 in comparison to stray ultrasonic signals that are received from stray sources.

The transceiver 76 is configured to transmit the echo profile (or the stream noise profile) to the mobile device 14 in response to the microphone capturing the audio in the ultrasonic range. In addition, the transceiver 76 is configured to wirelessly receive streaming audio for media playback and a signal corresponding to the alert from the mobile device 14. As noted above, the alert may correspond to the detection of object in the user's 16 blind field of view. It is recognized that there may be any number of transceivers 76 positioned within the headphones 12. The transceiver 76 is also configured to receive the alert from the mobile device 14 assuming the alert is to be audibly played back to the user when an object is detected to be in the user's 16 blind field of view.

The mobile device 14 generally includes at least one controller 80 (hereafter "controller 80"), memory 82, a power/battery supply 84 (hereafter power supply 84), a first transceiver 86, a user interface 90, speakers 92, a display 94, and a second transceiver 96. The power supply 84 powers the mobile device 14 (e.g., the electrical devices located within the mobile device 14). The first transceiver 86 is configured to receive the echo profile (or stream noise profile) from the headphones 12. The first transceiver 86 may also wirelessly transmit the alert to the headphones 12. There may be any number of transceivers positioned in the mobile device 14. It is recognized that the headphones 12 and the mobile device 14 may engage in communication with one another via an audio cable, Bluetooth®, WIFI, or other suitable communication mechanism/protocol. The mobile device 14 may also communicate with the server 32 via the second transceiver 96 in the event the processing block 30 is not implemented within the mobile device 14. In this case, the mobile device 14 and the processing block 30 may engage in communication with one another also via Bluetooth®, WIFI, or other suitable communication mechanism/protocol.

The user interface 90 enables the user to enter various rules that identify an object of interest, a time to search for the desired object, and/or location for identifying the object. The display 94 is configured to stream data images thereon of the object that is located in the user's 16 blind field of view. For example, the vehicles as noted above that are identified as an object to monitor in the user's blind field of view may be highlighted on the display 94 to enable the user 16 to take action that avoids the possibility of a future collision.

Figure 5:
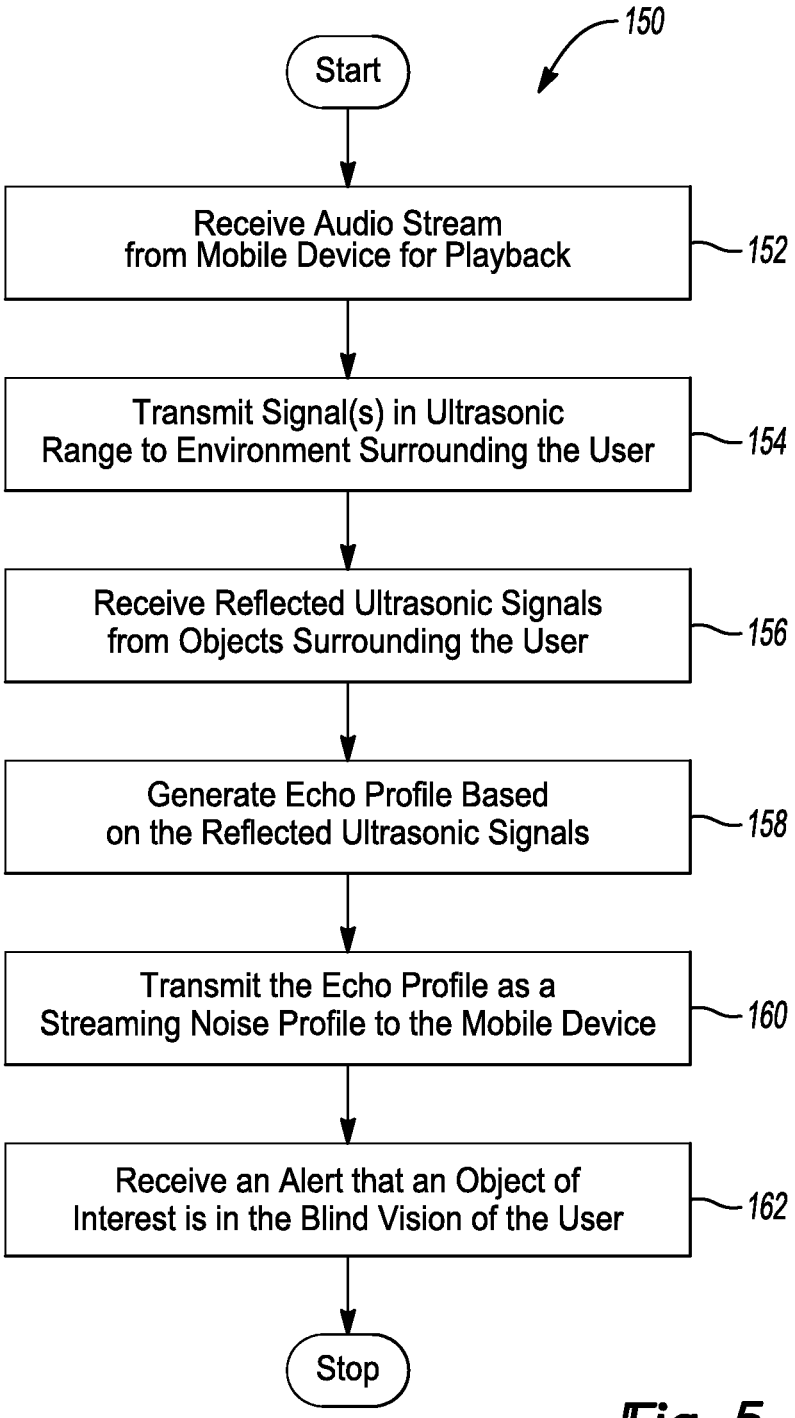
FIG. 5 generally depicts a first method for detecting objects outside of a user's field of view in accordance to one embodiment.

FIG. 5 generally depicts a first method 150 for detecting objects outside of the user's 16 field of view in accordance to one embodiment.

In operation 152, the headphones 12 receive an audio stream from the mobile device 14 to playback audio data for the user 16.

In operation 154, the headphones 12 transmit signals in the ultrasonic frequency range to the environment surrounding the user 16.

In operation 156, the headphones 12 receive reflected ultrasonic signals from objects surrounding the user 16.

In operation 158, the headphones 12 (e.g., the controller 70) generate an echo profile based on the reflected ultrasonic signals.

In operation 160, the headphones 12 transmit the echo profile as a streaming noise profile to the mobile device 14.

In operation 162, the headphones 12 receive an alert from the mobile device 14 indicating that an object of interest to the user 16 is positioned in the blind view of the user 16.

Figure 6:
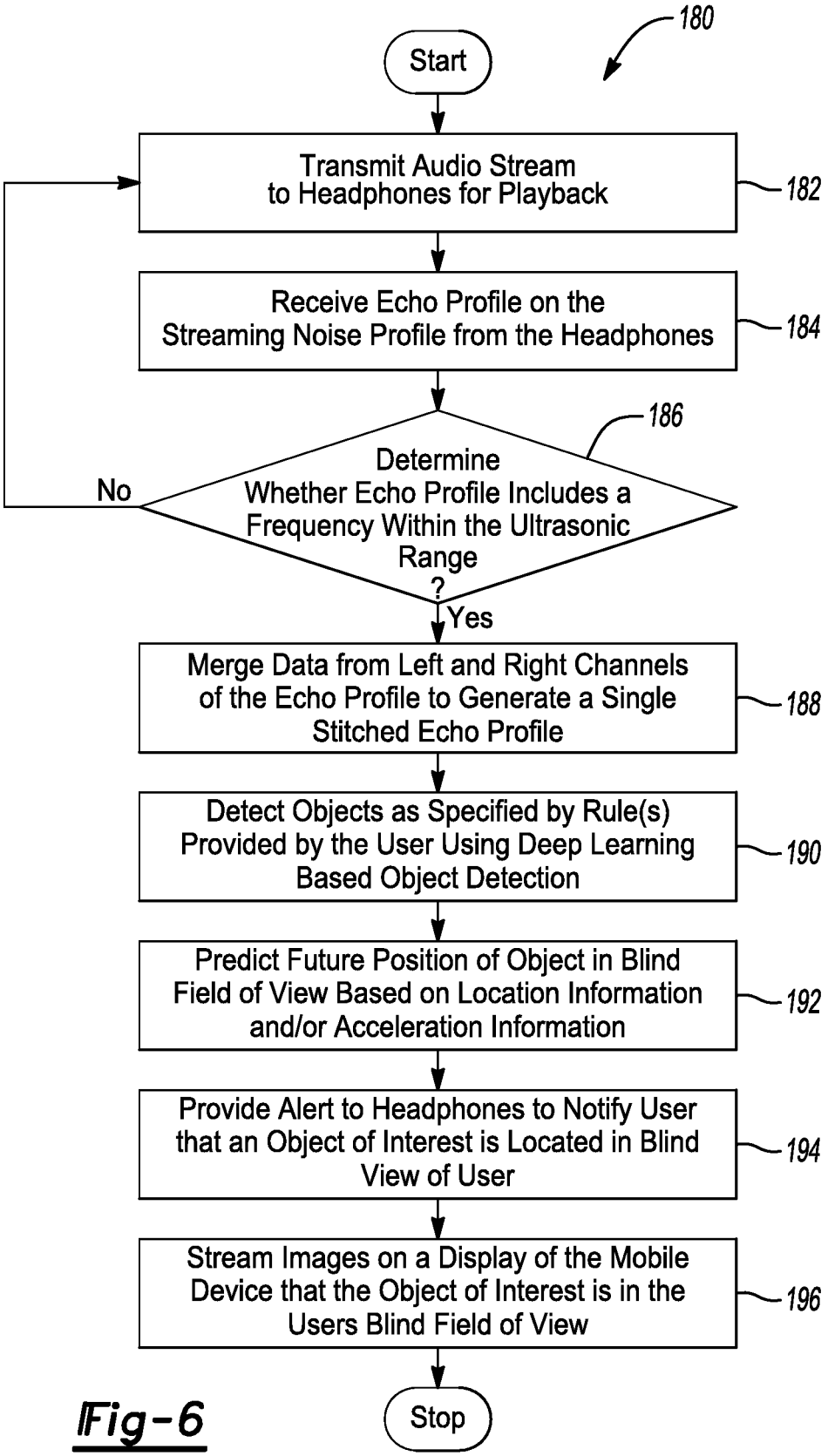
FIG. 6 generally depicts a second method for detecting objects outside of a user's field of view in accordance to one embodiment.

FIG. 6 generally depicts a second method 180 for detecting objects outside of a user's field of view in accordance to one embodiment. It is recognized that the mobile device 14 via the processing block 30 may execute one or more the operations of the method 180. The processing block 30 may be positioned within the mobile device 14. Alternatively, the processing block 30 may be positioned on the server 32 to offload computing resources for the mobile device 14. In this case, the mobile device 14 may transmit the streaming noise profile (or the echo profile) from the headphones 12 to the server 32 along with the position information and/or acceleration information of the mobile device 14.

In operation 182, the mobile device 14 transmits an audio stream to the headphones 12 for audio playback for the user 16.

In operation 184, the processing block 30 receives the echo profile on the streaming noise profile from the headphones 12.

In operation 186, the processing block 30 determines whether the echo profile includes a frequency that is within the ultrasonic frequency range. If the processing block 30 determines that the frequency is not within the ultrasonic frequency range, then the method 180 moves back to operation 182. If the processing block 30 determines that the frequency is within the ultrasonic frequency range, then the method 180 moves to operation 188.

In operation 188, the processing block 30 merges data from the right and left channels of the echo profile to generate a single stitched echo profile.

In operation 190, the processing block 30 detects the object(s) as specified by the rule(s) set forth by the user using a deep learning based detection.

In operation 192, the processing block 30 predicts a future position of the user 16 based on the location information provided by the GPS chipset 62 and/or acceleration information from the accelerometer 57 of the mobile device 14. As noted above, for future motion estimation, the processing block 30 executes a Kalman-filter based algorithm which receives inputs as a series of locations of the tagged objects from the previous frames on the echo profile and estimates the future position of these objects by Bayesian inference.

In operation 194, the processing block 30 transmits an alert signal to the headphones 12 to notify the user 16 that an object of interest is located in the blind view of the user 16. For example, the processing block 30 transmits the alert signal in response to determining that the future position of the user 16 is within a predetermined distance of the estimated future position of the object.

In operation 196, the processing block 30 streams images on the display 94 which illustrate that the object of interest is located in the user's blind field of view. This may be illustrated in real-time so that the user 16 may have an opportunity to respond to the object being in the blind field of view. For example, the mobile device 14 may provide a stream of video data that illustrates a moving vehicle in the blind view of the user 16 to give the user 16 ample time to move from the moving vehicle.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A computer-program product embodied in a non-transitory computer readable medium that is programmed to provide an alert for a user of an environment outside of the user's visual field of view, the computer-program product comprising instructions to:

receive an echo profile on two channels, the echo profile being indicative of at least one object outside of the user's visual field of view from headphones;

receive a command, from a user interface, the command being indicative of at least one object to detect on the echo profile;

generate the alert for the user to notify the user of a detected object in the user's visual field of view in the event the echo profile includes the at least one object;

determine whether the echo profile includes a frequency that is within an ultrasonic frequency range prior to generating the alert; and merge data of the echo profile as received on the two channels after determining that the echo profile includes the frequency that is within the ultrasonic frequency range to observe the at least one object in a blind view of the user prior to generating the alert.

2. The computer-program product of claim 1 wherein the ultrasonic frequency range corresponds to a frequency that is greater than 20 kHz.

3. The computer-program product of claim 1, wherein the merged data of the echo profile is formed into a single stitched echo profile to provide an image depth map.

4. The computer-program product of claim 3 further comprising instructions to perform a deep learning based object detection on objects present in the image depth map to detect the at least one object.

5. The computer-program product of claim 4 further comprising instructions to extract shapes from the image depth map and to compress the extracted shapes.

6. The computer-program product of claim 5 further comprising instructions to compare the compressed extracted shapes against previously known objects stored in memory.

7. The computer-program product of claim 1 further comprising instructions to:

receive at least one of acceleration information and location information of a mobile device; and execute a Kalman filter to estimate a future position of the at least one object in relation to the user.

8. The computer-program product of claim 7 further comprising instructions to receive the at least one of acceleration information and location information and to execute the Kalman filter prior to generating the alert for the user to notify the user of a detected object in the user's visual field of view.

9. The computer-program product of claim 1 wherein generating the alert for the user further includes streaming images on a display to alert the user of the detected object in the user's visual field of view in the event the echo profile includes the at least one object.

10. An apparatus for providing an alert for a user of an environment outside of the user's visual field of view, the apparatus comprising:

a mobile device being programmed to:

receive an echo profile on two channels, the echo profile being indicative of at least one object outside of the user's visual field of view from headphones;

receive a command from a user interface, the command being indicative of at least one object to detect on the echo profile;

generate the alert for the user to notify the user of a detected object in the user's visual field of view in the event the echo profile includes the at least one object;

determine whether the echo profile includes a frequency that is within an ultrasonic frequency range prior to generating the alert; and merge data of the echo profile as received on the two channels after determining that the echo profile includes the frequency that is within the ultrasonic frequency range to observe the at least one object in a blind view of the user prior to generating the alert.

11. The apparatus of claim 10 wherein the mobile device is further programmed to transmit an audio stream to the headphones for playback while receiving the echo profile from the headphones.

12. The apparatus of claim 10 wherein the mobile device is further programmed to: provide at least one of acceleration information and location information to determine a future position of the user; and execute a Kalman filter to estimate a future position of the at least one object in relation to the user.

13. The apparatus of claim 12 wherein the mobile device is further configured to provide at least one of acceleration information and location information to determine a future position of the user and execute the Kalman filter to estimate a future position of the at least one object in relation to the user.

14. The apparatus of claim 10 wherein the mobile device is further programmed to stream images on a display thereof to alert the user of the detected object in the user's visual field of view in the event the echo profile includes the at least one object.

15. A system for monitoring an environment outside of a user's visual field of view, the system comprising:

headphones including at least one audio speaker and at least one microphone, the headphones being programmed to:

receive an audio stream from a mobile device playback the audio stream via the at least one audio speaker;

transmit a first signal in an ultrasonic range to an area exterior to the headphones;

receive, via the at least one microphone, a reflected first signal in the ultrasonic range from at least one object surrounding the user; and transmit an echo profile indicative of at least one object outside of the user's visual field of view in response to the received reflected first signal; and a mobile device being programmed to:

receive an echo profile on two channels;

determine whether the echo profile includes a frequency that is within an ultrasonic frequency range; and merge data of the echo profile as received on the two channels after determining that the echo profile includes the frequency that is within the ultrasonic frequency range to observe the at least one object in a blind view of the user.

16. The system of claim 15 wherein the ultrasonic range corresponds to a frequency that is greater than 20 kHz.

17. The system of claim 15 wherein the at least one microphone is tuned to capture audio in a range of 20 Hz-20 kHz and tuned to capture the reflected first signal in the ultrasonic range of a frequency that is greater than 20 kHz.

* * * * *